US007481299B2

(12) United States Patent
Mustalahti et al.

(10) Patent No.: US 7,481,299 B2
(45) Date of Patent: Jan. 27, 2009

(54) ELEVATOR WITH COMPENSATING DEVICE

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/431,083

(22) Filed: May 10, 2006

(65) Prior Publication Data

US 2006/0243541 A1 Nov. 2, 2006

Related U.S. Application Data

(63) Continuation of application No. PCT/FI2004/000706, filed on Nov. 22, 2004.

(30) Foreign Application Priority Data

Nov. 24, 2003 (FI) ..... 20031709

(51) Int. Cl.
*B66B 11/08* (2006.01)

(52) U.S. Cl. ..... 187/264; 187/266; 187/412

(58) Field of Classification Search ..... 187/412, 187/414, 266, 264, 343, 344, 347
See application file for complete search history.

(56) References Cited

U.S. PATENT DOCUMENTS

| | | | | | |
|---|---|---|---|---|---|
| 657,380 | A | | 9/1900 | Baldwin | |
| 718,762 | A | * | 1/1903 | Hiss | 187/264 |
| 912,256 | A | * | 2/1909 | Neenan | 187/264 |
| 1,944,722 | A | * | 1/1934 | Soderberg | 206/1.5 |
| 1,944,772 | A | * | 1/1934 | White | 187/265 |
| 3,174,585 | A | * | 3/1965 | Tofanelli | 187/264 |
| 5,513,724 | A | * | 5/1996 | De Jong | 187/264 |
| 5,788,018 | A | * | 8/1998 | Mendelsohn et al. | 187/404 |
| 6,138,799 | A | * | 10/2000 | Schroder-Brumloop et al. | 187/252 |
| 6,193,017 | B1 | | 2/2001 | Koester | |
| 6,364,061 | B2 | * | 4/2002 | Baranda et al. | 187/254 |
| 7,207,421 | B2 | * | 4/2007 | Aulanko et al. | 187/266 |
| 2003/0155185 | A1 | * | 8/2003 | Nomura et al. | 187/266 |
| 2004/0216959 | A1 | * | 11/2004 | Ach | 187/264 |

FOREIGN PATENT DOCUMENTS

| | | | | |
|---|---|---|---|---|
| DE | 1251926 | | * | 4/1965 |
| DE | 2441992 | A | * | 4/1975 |
| FR | 2 823 734 | A1 | | 10/2002 |
| FR | 2823734 | A1 | * | 10/2002 |
| GB | 2250012 | A | * | 5/1992 |
| WO | WO 99/43600 | | | 9/1999 |
| WO | WO 03043922 | A1 | * | 5/2003 |

* cited by examiner

*Primary Examiner*—Peter M Cuomo
*Assistant Examiner*—Stefan Kruer
(74) *Attorney, Agent, or Firm*—Harness, Dickey & Pierce, P.L.C.

(57) ABSTRACT

An elevator, which preferably is an elevator without counterweight and in which an elevator car is suspended by means of a set of hoisting ropes comprising one rope or a number of parallel ropes. The elevator has a traction sheave that moves the elevator car by means of the hoisting ropes. The elevator comprises rope portions of hoisting ropes going upwards and downwards from the elevator car, and the elevator has a compensating device acting on the hoisting ropes to equalize and/or compensate rope tension and/or rope elongation. The compensating device acting on the hoisting ropes of the elevator comprises at least one slack rope prevention means for preventing uncontrolled slackening of the hoisting ropes and/or uncontrolled motion of the compensating device.

20 Claims, 8 Drawing Sheets

ELEVATOR WITH COMPENSATING DEVICE

PRIORITY STATEMENT

This application is a continuation of PCT/FI2004/000706, filed on Nov. 22, 2004, which is an international application claiming priority from FI 20031709, filed on Nov. 24, 2003, the entire contents of which are hereby incorporated by reference.

BACKGROUND

1. Field

The present invention relates to elevators and to methods for preventing uncontrolled slackening of the hoisting ropes and/or uncontrolled movement of a compensating device in an elevator.

2. Description of Related Art

One of the objectives in elevator development work is to achieve an efficient and economical utilization of building space. In recent years, this development work has produced various elevator solutions without machine room, among other things. Good examples of elevators without machine room are disclosed in specifications EP 0 631 967 (A1) and EP 0 631 968. The elevators according to these specifications are fairly efficient in respect of space utilization as they have made it possible to eliminate the space needed for the machine room in the building without a need to enlarge the elevator shaft. The machine used in the elevators according to these specifications is compact in at least one direction, but in other directions it may be much larger than conventional elevator machines.

In these basically good elevator solutions, the space and placement of the hoisting machine limits the freedom of choice in elevator lay-out solutions. The arrangements for the passage of the hoisting ropes require space. The space required by the elevator car itself on its track, and likewise the space needed for the counterweight, can not be easily reduced, at least at a reasonable cost and without compromising on the performance and quality of operation of the elevator. In a traction sheave elevator without machine room, installing the hoisting machine in the elevator shaft, especially in the case of solutions with machine above, is often difficult because the hoisting machine is a fairly heavy and large object. Especially in elevators for larger loads, speeds and/or hoisting heights, the size and weight of the machine are a problem in respect of installation, even so much so that the required machine size and weight have in practice limited the scope of application of the concept of elevator without machine room, or at least retarded the introduction of said concept in larger elevators. The space available in the elevator shaft in elevator modernization projects has often limited the scope of application of the concept of elevator without machine room. Often, especially in cases of modernization or replacement of hydraulic elevators, it has not been practical to apply a roped elevator solution without machine room, due to insufficient space in the elevator shaft especially in a situation where no counterweight has been used in the hydraulic elevator solution to be modernized/replaced. The drawbacks of elevators provided with a counterweight include the cost of the counterweight and the space required for the counterweight in the elevator shaft. Drum-driven elevators, which at present are quite rare, have the disadvantages of heavy and complicated hoisting machines and their high power and/or torque requirements. Prior-art elevator solutions without counterweight are exotic and no appropriate solutions are known. So far, it has not been technically or economically reasonable to make elevators without counterweight. One solution like this is disclosed in specification WO9806655. A recent international patent application discloses a feasible solution. In prior-art elevator solutions without counterweight, the tensioning of the hoisting rope is implemented using a weight or spring, and that is not an attractive approach to implementing the tensioning of the hoisting rope. Another problem with elevators without counterweight, when long ropes are used e.g. due to a large hoisting height or large suspension ratios used, the compensation of rope elongations and at the same time, due to rope elongations, the friction between the traction sheave and the hoisting ropes is insufficient for the operation of the elevator. A further problem is how to ensure the compensation of rope elongations and the operating reliability of the compensating device. In the case of elevators without counterweight, ensuring a sufficient safety space in the shaft is a problem. Another problem in an elevator without counterweight is uncontrolled slackening of the hoisting ropes and a risk of the ropes getting tangled, especially in a situation where the elevator car is driven onto the buffers.

SUMMARY

The general aim of the invention is to achieve at least one the following objectives. On the one hand, it is an objective of the invention to develop the elevator without machine room so as to achieve more efficient space utilization in the building and in the elevator shaft than before. This means that the elevator should permit of being installed in a relatively narrow elevator shaft if necessary. On the other hand, it is an objective of the invention to eliminate dangerously large elongation of elevator hoisting ropes. Another objective is to prevent uncontrolled slackening of the set of hoisting ropes, especially in a situation where the elevator car is driven onto the buffer. A further objective is to prevent uncontrolled movement of the compensating device acting on the hoisting ropes.

The elevator of the invention is described below. Other embodiments of the invention are also described below. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts.

By applying the invention, one or more of the following advantages, among others, can be achieved:

- the movement of the compensating device can be easily and reliably implemented by applying the invention
- the apparatus of the invention reduces the risk of the hoisting ropes getting tangled with other equipment in the shaft in situations where uncontrolled slackening of the rope appears, such as e.g. when the elevator car is driven onto the buffers or when the safety gear of the elevator is activated
- by applying the invention, the movement of the compensating device can be controlled and its operation is prevented in the above-mentioned situations where uncontrolled slackening of the hoisting ropes occurs
- the service life of the hoisting ropes is increased and the risk of failure is reduced as the motion of the hoisting ropes is better controlled by means of the device of the invention for preventing rope slackening the elevator of the invention has a better operating reliability and the operation of the compensating device in the desired manner can be easily ensured by applying the invention the required tension of the hoisting ropes can be maintained even in situations where a slackening of the hoisting ropes occurs, especially in the hoisting rope portion above the elevator car.

The primary area of application of the invention is elevators designed for transporting people and/or freight. A normal area of application of the invention is in elevators whose speed range is about or below 1.0 m/s but may also be higher. For example, an elevator traveling at a speed of 0.6 m/s is easy to implement according to the invention.

In the elevator of the invention, normal elevator ropes, such as generally used steel wire ropes, are applicable. The elevator may use ropes of synthetic material and rope structures with a synthetic-fiber load-bearing part, such as e.g. so-called "aramid" ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. Using round wires, the rope can be twisted in many ways using wires of the same or different thicknesses. In ropes well applicable with the invention, the wire thickness is below 0.4 mm on an average. Well-suited ropes made from strong wires are those in which the average wire thickness is under 0.3 mm or even under 0.2 mm. For example, thin-wired and strong 4-mm ropes can be twisted relatively advantageously from wires such that the average wire thickness in the finished ropes is between 0.15 . . . 0.25 mm, in which the thinnest wires may even have a thickness of only about 0.1 mm. Thin rope wires can be easily made quite strong. In the invention, rope wires having a strength greater than about 2000 N/mm$^2$. Appropriate rope wire strengths are 2300-2700 N/mm$^2$. In principle, it is possible to use rope wires having a strength of about 3000 N/mm$^2$ or even more.

The elevator of the invention is preferably an elevator without counterweight in which the elevator car is at least partially suspended on a set of hoisting ropes comprising at least one rope or a number of parallel ropes, the elevator having a traction sheave which moves the elevator car by means of the hoisting ropes. The elevator comprises rope portions of hoisting ropes going upwards and downwards from the elevator car. In addition, the elevator has a compensating device acting on the hoisting ropes to equalize and/or compensate rope tension and/or rope elongation. In the elevator of the invention, the compensating device acting on the hoisting ropes comprises at least one slack rope prevention means for preventing uncontrolled slackening of the hoisting ropes and/or uncontrolled motion of the compensating device.

The method of the invention relates to prevention of uncontrolled slackening of hoisting ropes and/or uncontrolled motion of the compensating device of an elevator. In the elevator, the elevator car is at least partially supported by a set of hoisting ropes, said set of hoisting ropes comprising at least one rope or a number of parallel ropes. The elevator has a traction sheave which moves the elevator car by means of the hoisting ropes, and the elevator comprises rope portions of hoisting ropes going upwards and downwards from the elevator car. The elevator has a compensating device acting on the hoisting ropes to equalize and/or compensate rope tension and/or rope elongation. In the method of the invention, incipient rope slackening is detected by means of an arrangement provided in conjunction with the compensating device and the compensating device is prevented from delivering rope from the compensating device in the direction of the rope portions below the elevator car.

By increasing the contact angle using a rope pulley functioning as a diverting pulley, the grip between the traction sheave and the hoisting ropes can be improved. Therefore, a car of lighter weight as well as smaller size can be used, thus increasing the space-saving potential of the elevator. A contact angle of over 180° between the traction sheave and the hoisting rope is achieved by utilizing a diverting pulley or diverting pulleys. The need to compensate rope elongation follows from the friction requirements, in order to ensure a grip between the hoisting rope and the traction sheave that is sufficient in respect of operation and safety of the elevator. On the other hand, in respect of operation and safety of the elevator, it is essential that the rope below the elevator car of an elevator without counterweight is held under sufficient tension. This can not necessarily be achieved by using a spring or a simple lever.

BRIEF DESCRIPTION OF THE DRAWINGS

In the following, the invention will be described in detail with reference to embodiment examples and the attached drawings, wherein.

DETAILED DESCRIPTION OF EXAMPLE EMBODIMENTS

Figure 1:
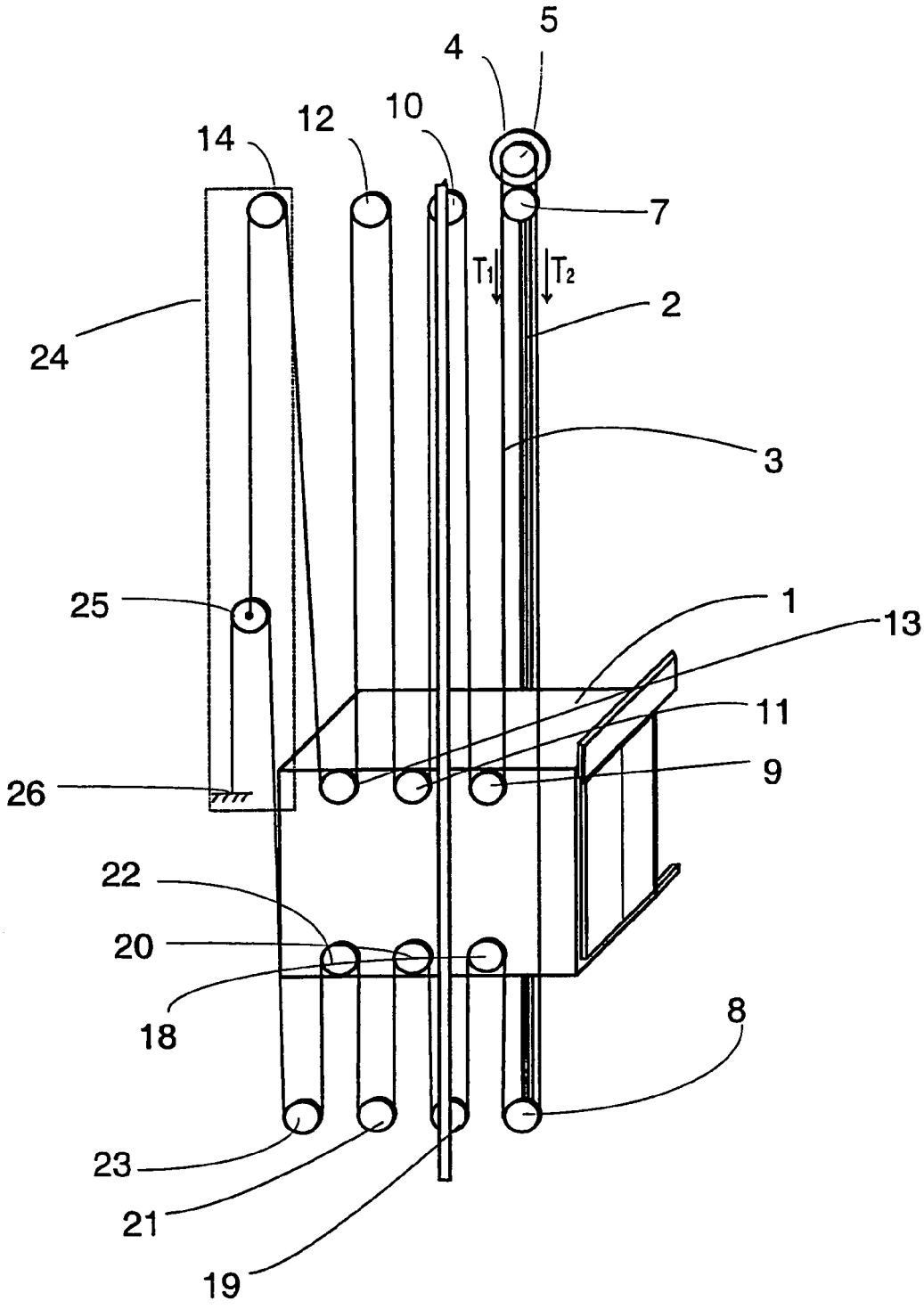
FIG. 1 is a diagram representing a traction sheave elevator without counterweight according to the invention in general.

FIG. 1 presents a general view of a traction sheave elevator without counterweight according to the invention without the slack rope prevention means of the invention fitted in conjunction with the compensating device. The elevator is preferably an elevator without machine room and with a drive machine 4 placed in the elevator shaft. The elevator presented in the figure is a traction sheave elevator without counterweight and with machine above, in which the elevator car 1 moves along guide rails 2. In elevators designed for a large hoisting height, elongation of the hoisting rope involves a need to compensate the rope elongation, and this has to be done reliably within certain allowed limit values. In this connection, it is essential to the operation and safety of the elevator that the hoisting rope portion below the elevator car be kept under sufficient tension. In the rope force equalizing sheave assembly 24 of the invention presented in FIG. 1, a very long movement for the compensation of rope elongation is achieved. This allows compensation of even very large elongations, which is often not possible if simple lever or spring solutions are used. The compensating sheave arrangement presented in FIG. 1 maintains a constant ratio $T_1/T_2$ between the rope forces $T_{1\ and\ T2}$ acting over the traction sheave. In the case illustrated in FIG. 1, the $T_1/T_2$ ratio is 2/1. With even suspension ratios above and below the elevator car, the compensating device 24 is fitted in the elevator shaft or in some other corresponding appropriate place not in conjunction with the elevator car, and with odd suspension ratios above and below the elevator car the compensating device 24 is fitted in conjunction with the elevator car 1.

In FIG. 1, the hoisting ropes run as follows: One end of the hoisting ropes 3 is fixed to a diverting pulley 25 fitted to hang on a rope portion coming downwards from diverting pulley 14. Diverting pulleys 14 and 25 together with the fixing point 26 of the second end of the hoisting rope constitute a rope force equalizing system 24, which in the case illustrated in FIG. 1 is a compensating sheave assembly. This compensating device 24 is fitted in place in the elevator shaft. From diverting pulley 25, the hoisting ropes 3 go upwards and meet a diverting pulley 14 placed above the elevator car in the elevator shaft, preferably in the upper part of the elevator shaft, passing around it along rope grooves provided on the diverting pulley 14. These rope grooves may be coated or uncoated, the coating used may be e.g. a friction-increasing material, such as polyurethane or some other appropriate material. From diverting pulley 14, the ropes go further downwards to a diverting pulley 13 fitted in place on the elevator car, and having passed around this pulley the ropes go further upwards to a diverting pulley 12 fitted in place in the upper part of the elevator shaft. Having passed around diverting pulley 12, the ropes come again downwards to a diverting pulley 11 fitted in place on the elevator car, pass around it and go further upwards to a diverting pulley 10 fitted in place in the upper part of the elevator shaft, and having passed around this pulley the hoisting ropes 3 go further downwards to a diverting pulley 9 fitted in place on the elevator car. Having passed around this pulley 9, the ropes 3 go further upwards in tangential contact with diverting pulley 7 to the traction sheave 5. Diverting pulley 7 is preferably fitted near and/or in conjunction with the hoisting machine 4. Between diverting pulley 7 and the traction sheave 5, the figure shows Double Wrap (DW) roping, in which roping the hoisting ropes 3 go in tangential contact with diverting pulley 7 upwards to diverting pulley 5 and, having passed around the traction sheave 5, the hoisting ropes return to diverting pulley 7, pass around it and go back to the traction sheave 5. In Double Wrap roping, when diverting pulley 7 is substantially the same size with the traction sheave 5, diverting pulley 7 may also function as a damping pulley. In this case, the ropes going from the traction sheave 5 to the elevator car 1 pass via the rope grooves of the diverting pulley 7 and the deflection of the rope caused by the diverting pulley is very small. It could be stated that the ropes going from the traction sheave 5 to the elevator car and the ropes coming to it only run in "tangential contact" with diverting pulley 7. Such "tangential contact" functions as a solution damping vibrations of the outgoing ropes and it can also be applied in other roping solutions. An example of other roping solutions is Single Wrap (SW) roping, wherein the diverting pulley is substantially of the same size with the traction sheave and the diverting pulley is used as a "tangential contact sheave" as described above. In the SW roping according to the example, the ropes are passed only once around the traction sheave, so the contact angle of the rope on the traction sheave is about 180° and the diverting pulley is only used as an auxiliary wheel for "tangential contact" of the rope as described above and wherein the diverting pulley functions as a rope guide and a damping pulley suppressing vibrations. Diverting pulleys 14,13,12,11,10,9,7 together with the traction sheave 5 of the hoisting machine 4 form the suspension above the elevator car, which has the same suspension ratio as the suspension below the elevator car, which suspension ratio in FIG. 1 is 6:1. From the traction sheave 5, the ropes go further in tangential contact with diverting pulley 7 to diverting pulley 8, which is preferably fitted in place in the lower part of the elevator shaft. Having passed around diverting pulley 8, the ropes 3 go further upwards to a diverting pulley 18 fitted in place on the elevator car, and having passed around said diverting pulley 18 the ropes go further downwards to a diverting pulley 19 in the lower part of the elevator shaft and, having passed around this pulley, return to a diverting pulley 20 fitted in place on the elevator car. Having passed around diverting pulley 20, the hoisting ropes 3 go further downwards to a diverting pulley 21 fitted in place in the lower part of the elevator shaft, pass around it and go further upwards to a diverting pulley 22 on the elevator car. Having passed around diverting pulley 22, the hoisting ropes 3 go further downwards to a diverting pulley 23 fitted in place in the lower part of the elevator shaft, pass around it go further upwards, returning to the diverting pulley 25 of the compensating device, and having passed around it the hoisting ropes go further to the fixing point 26 of their second end, which is located in a suitable place in the elevator shaft. Diverting pulleys 8,18,19,20,21,22,23 form the suspension and rope portion below the elevator car. The hoisting machine 4 and traction sheave 5 of the elevator and/or the diverting pulleys 7,10,12,14 in the upper part of the elevator shaft may be mounted in place on a frame structure formed by the guide rails 2 or on a beam structure at the upper end of the elevator shaft or separately in the elevator shaft or on some other appropriate mounting arrangement. The diverting pulleys in the lower part of the elevator shaft may be mounted in place on a frame structure formed by the guide rails or to a beam structure placed at the lower end of the elevator shaft or separately in the lower part of the elevator shaft or on some other appropriate mounting arrangement. The diverting pulleys on the elevator car may be mounted in place on the frame structure of the elevator car or to a beam structure or beam structures in the elevator car or separately on the elevator car or some other appropriate mounting arrangement.

The elevator car 1 is provided with one or more diverting pulleys from which the hoisting ropes go upwards and one or more diverting pulleys from which the hoisting ropes go downwards. For example, the number of each type of pulley may be 1, 2, 3, 4, 5, or even more.

In the elevator presented in FIG. 1, the rope force equalizing sheave assembly 24 compensates rope elongations by the movement of the diverting pulley 25. The diverting pulley 25 moves through a limited distance 1, thereby compensating elongations of the hoisting ropes 3. The compensation distance 1 equals half the rope elongation of the hoisting ropes. In addition, this arrangement keeps the rope tension over the traction sheave 5 at a constant level, so that the $T_1/T_2$ ratio between the rope forces in the situation shown in FIG. 1 is 2/1. The rope force compensating sheave assembly 24 can also be implemented in other ways besides that presented in the example, such as by using more complex suspension arrangements in the rope force compensating sheave assembly (e.g., different suspension ratios between the diverting pulleys in the compensating sheave assembly).

Figure 2:
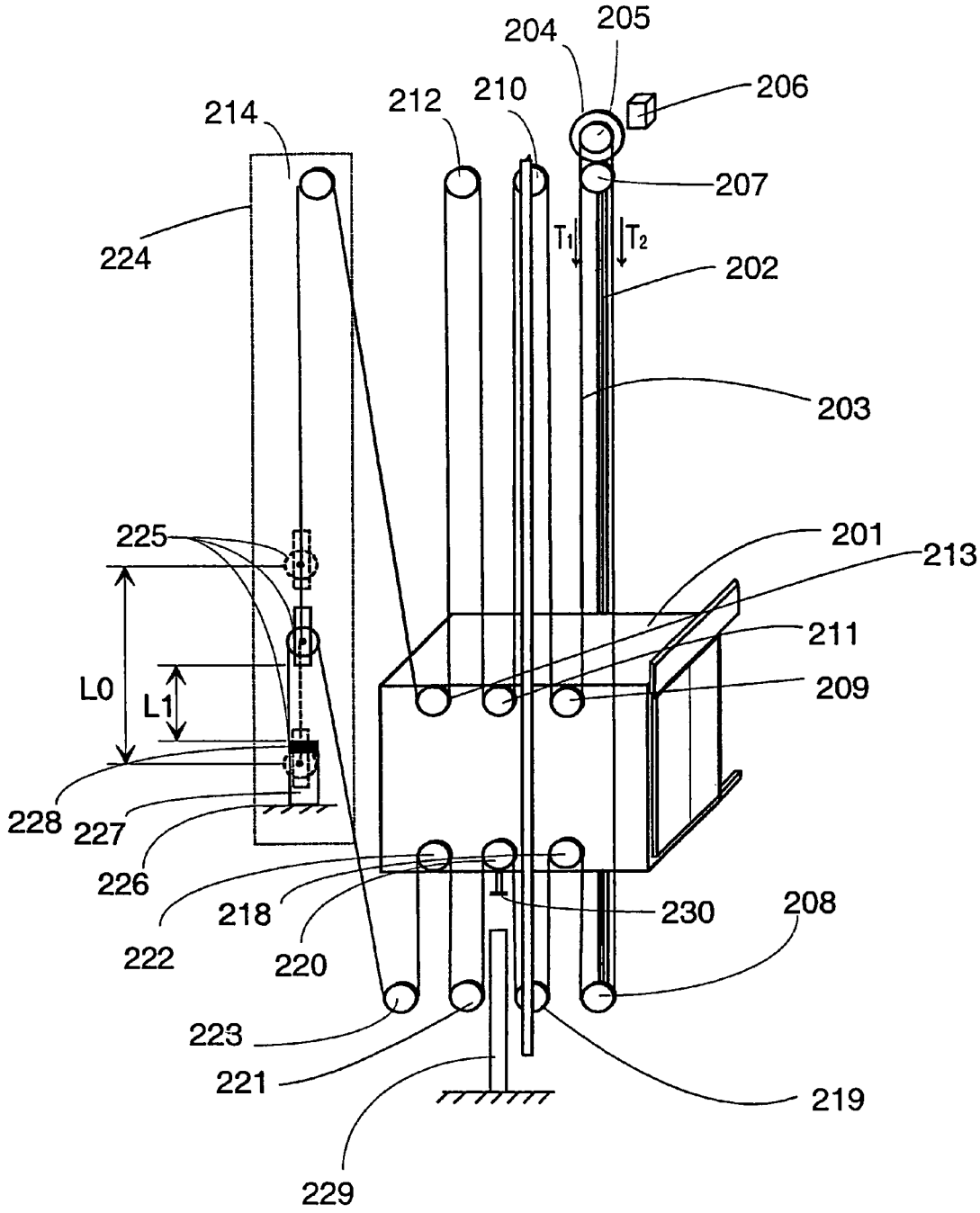
FIG. 2 is a diagram representing a second traction sheave elevator without counterweight according to the invention and a compensating device according to the invention.
Figure 8:
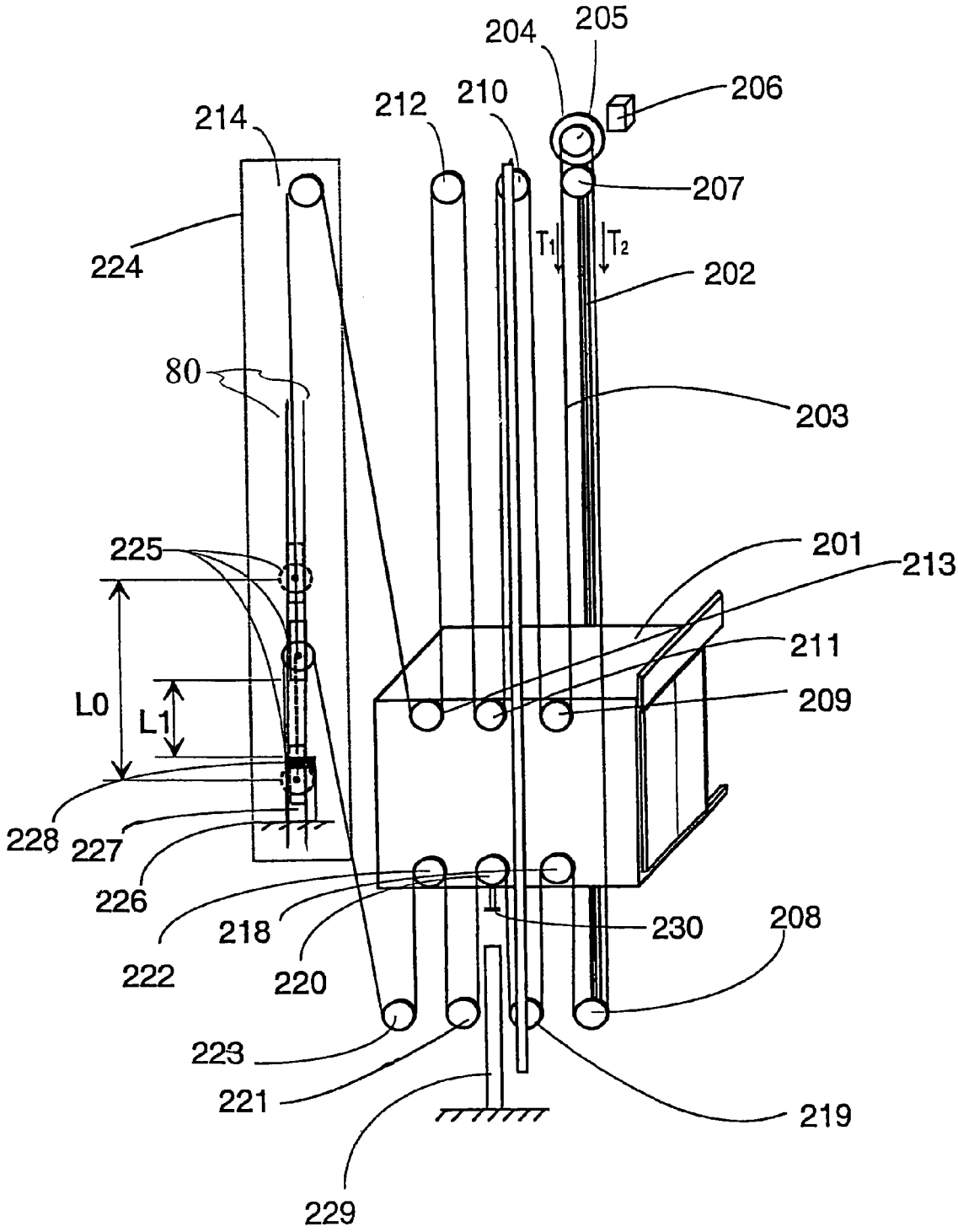
FIG. 8 is a diagram representing a traction sheave elevator and compensating device, similar to FIG. 2, wherein the compensating device is guided by guide rails or guiding ropes.

FIG. 2 presents a traction sheave elevator without counterweight according to the invention, which elevator also features a slack rope prevention means 227 in the compensating device to prevent uncontrolled slackening of the hoisting ropes 203 and/or uncontrolled movement of the compensating device. The elevator is preferably an elevator without machine room and with a drive machine 204 placed in the elevator shaft. The elevator presented in FIG. 2 is a traction sheave elevator without counterweight and with machine above, in which the elevator car 201 moves along guide rails 202. FIG. 2 also shows a buffer 229 fitted below the elevator car to form a safety space below the elevator car and/or to prevent the elevator car from moving too far down in the elevator shaft. Fitted on the elevator car is a counterpiece 230 designed to meet the buffer, which has been fitted in place in the elevator shaft, preferably on the bottom of the elevator shaft. The passage of the hoisting ropes 203 in FIG. 2 corresponds to that in the elevator presented in FIG. 1. The suspension ratio of the elevator car is also similar to that in the elevator presented in FIG. 1, i.e., 6:1 in the rope portions both above and below the elevator car. In the case of an elevator without counterweight, the risk of the hoisting ropes 203 getting tangled is very highs, e.g., when the elevator is driven onto the buffer or the safety gear of the elevator car grips. To overcome this problem, a device that prevents uncontrolled motion of the hoisting rope set is needed. 'Rope set' refers to one or more parallel ropes in the hoisting roping. FIG. 2 presents a slack rope prevention means 227 designed to prevent slackening of the hoisting ropes. The function of the slack rope prevention means is to ensure that in situations where slackening of the hoisting ropes occurs, such as, e.g., when the elevator car is driven onto the buffer 229, the rope elongation accumulated in the rope set of the hoisting ropes 203 can not be completely discharged, so that the hoisting rope remains in its proper position and the hoisting ropes can not be tangled with shaft structures. Another function that the slack rope prevention means presented in FIG. 2 has in the elevator of the invention is to prevent uncontrolled movement of the compensating device, especially in a situation where the safety gear of the elevator car grips. In the elevator of the invention, incipient slackening of the hoisting ropes is detected by an arrangement placed in conjunction with the compensating device 224, in the case of FIG. 2 by the slack rope prevention means 227, and at the same time the compensating device is prevented from delivering rope from the compensating device in the direction of the rope portions below the elevator car. In FIG. 2, when the car is driven onto the buffer 229 in connection with maintenance operation or for some other reason, the rope stress acting on the hoisting rope portion above the elevator car is reduced, and therefore the rope force $T_1$ acting on it is reduced as well. The rope elongation now occurring tends to be discharged into the hoisting ropes and the diverting pulley 225, which serves as the diverting pulley of the compensating device, immediately starts moving downwards in the compensating device. If the elevator car is driven further downwards against the buffer 229, then the hoisting machine 204 will go on pulling more rope from the hoisting rope portion below the elevator car 201 until the rope force $T_1$ on the other side of the traction sheave 205 is reduced to a level at which the friction between the traction sheave and the hoisting ropes is no longer sufficient and the traction sheave consequently starts slipping. The compensating device comprises a buffer 227 used as a slack rope prevention means, which is placed at a height such that the compensating sheave 225 will remain supported on the buffer before the entire rope elongation has been discharged into the roping, especially into the roping portion above the elevator car. The buffer 227 is installed at a correct distance relative to the path of the compensating sheave 225 at a stage when all the components comprised in the suspension of the elevator car have been mounted in place and the elevator car 201 has been fully completed. When all the components suspended on the hoisting ropes 203 are in place and the car is at the lowest level, the rope elongation occurring in the hoisting ropes is at a maximum without load, and thus the length of the hoisting ropes is also at a maximum in a situation without load. In this situation, a desired distance $L_1$ is measured and fitted between the buffer 227 and the compensating sheave 225 and its suspension, whereupon the buffer is fitted in place in its final position. The distance $L_1$ may preferably be, e.g., 200 mm. After the buffer has been fitted in place, the compensating device is ready for operation. The maximal limited compensating distance covered by the compensating device is distance $L_0$ shown in FIG. 2, and this distance is limited at one end to a desired length by the buffer 227. The compensating device has a limited compensating distances, e.g., because the compensating device is guided by guide rails and the compensating range between their ends is a range that forms the theoretical limited operating range of the compensating device, which range in FIG. 2 is $L_0$. Within this range, the compensating device works in the desired manner, but when the extremities of the compensating device are reached, such as, e.g., the fixing point 226 of the hoisting ropes, the compensating device will not necessarily function in the desired manner and the operation of the elevator is impaired. The aim in the elevator of the invention is to ensure that when the normal compensating range of the compensating device is exceeded, the compensating device will be prevented from delivering rope from the compensating device in the direction of the rope portions below the elevator car, which makes it possible to maintain a certain tension in the hoisting ropes. Diverting pulley 225, which in FIG. 2 serves as a compensating sheave, may be guided by guide rails to keep it on its track, especially in situations where the compensating sheave assembly 224 is subjected to a strong impact, such as, e.g., a situation where the elevator safety gear grips. By means of the guides of the compensating sheave 225, a desired clearance between the elevator car and the compensating device can be maintained and the motion of the compensating device controlled. The guide rails of the compensating device may be almost any type of guide rails appropriate for the purpose, such as, e.g., guide rails 80 (as shown, for example, in FIG. 8) made of metal or some other appropriate material or, e.g., guiding ropes. The buffer 227 used as a slack rope prevention means in the compensating device can also be provided with a damping part 228 fitted in a desired position to damp the impact between the compensating sheave 225 and the buffer 227, especially in a situation where uncontrolled and/or fast motion of the compensating device occurs, such as, e.g., in a situation where the safety gear of the elevator grips, in which situation $T_1$ is abruptly reduced and consequently the compensating device 224 immediately starts moving downwards at a high speed. The resulting impact between the buffer 227 and the compensating sheave 225 is damped to avoid damage of the compensating device or the hoisting ropes. As a damping part 228 on the buffer 227, it is possible to use, e.g., a rubber pad, a gas spring, or some other damping part appropriate for the purpose. The elevator presented in FIG. 2 may also be suspended using other applicable suspension ratios above and below the elevator car, e.g., 8:1, 10:11, or some other appropriate suspension ratio.

Figure 3:
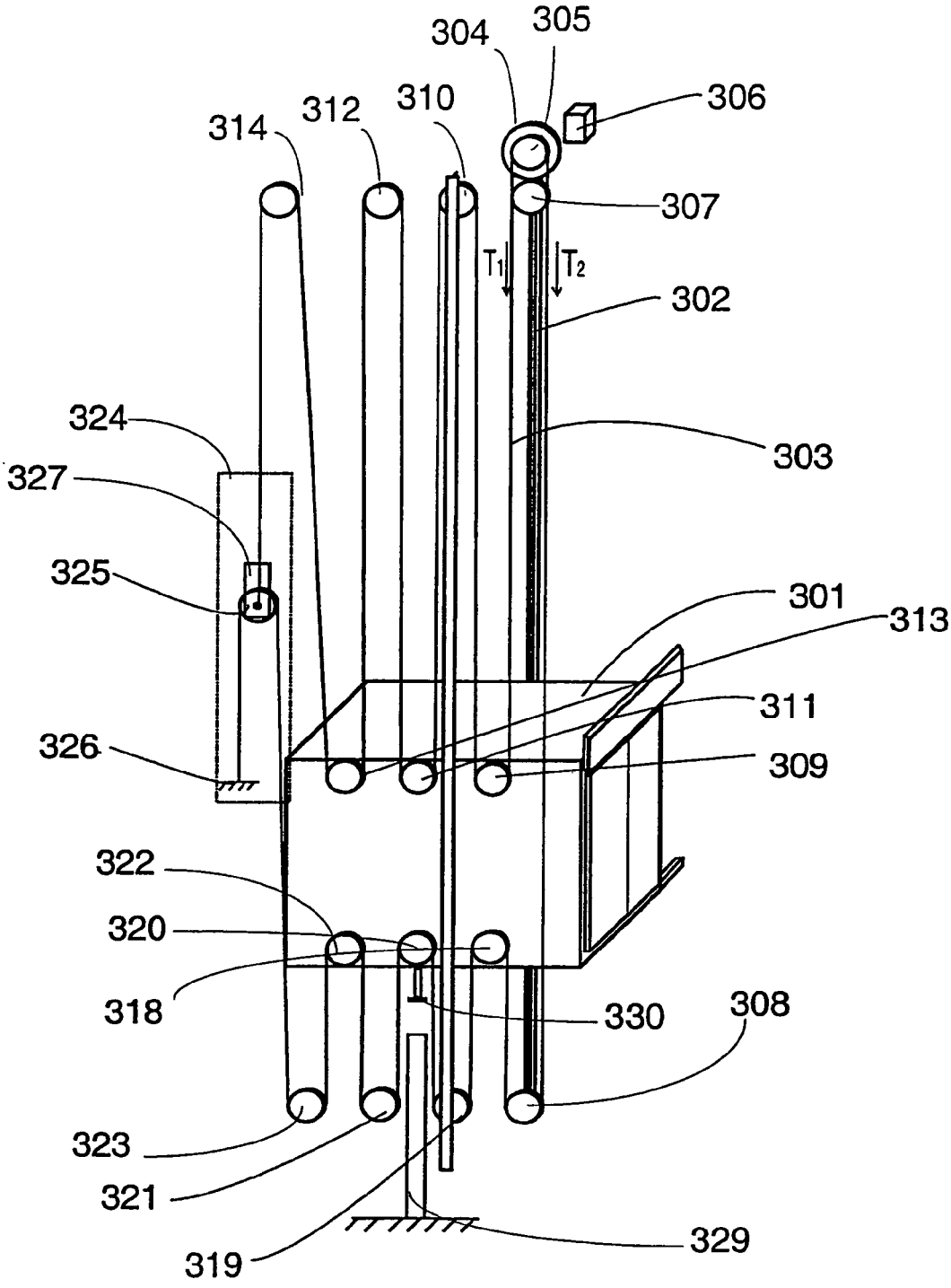
FIG. 3 is a diagram representing a third traction sheave elevator without counterweight according to the invention and a compensating device according to the invention.

FIG. 3 presents an elevator according to the invention which also has a slack rope prevention means 327 provided in a compensating device to prevent uncontrolled slackening of the hoisting ropes 303 or uncontrolled motion of the compensating device 324. The elevator is preferably an elevator without machine room and with a drive machine 304 placed in the elevator shaft. The elevator presented in the figure is a traction sheave elevator without counterweight and with machine above, in which the elevator car 301 moves along guide rails 302. FIG. 3 also presents a buffer 329 fitted below the elevator car to form a safety space below the elevator car and/or to prevent the elevator car from moving too far down in the elevator shaft. Fitted on the elevator car is a counterpiece 330 designed to meet the buffer 329, which is fitted in place in the elevator shaft, preferably on the bottom of the elevator shaft. The passage of the hoisting ropes 303 corresponds to that in the elevators presented in FIGS. 1 and 2. The suspension ratio of the elevator car is also the same as in the elevators presented in FIGS. 1 and 2, i.e. 6:1 both in the rope portion above the elevator car and in the rope portion below the elevator car. The elevators presented in FIG. 3 may also be suspended using other applicable suspension ratios above and below the elevator car, such as e.g. 7:1, 8:1, 9:1, 10:1 or some other appropriate suspension ratio. In the case of an elevator without counterweight, the risk of the hoisting ropes 303 getting tangled is very high e.g. when the elevator is driven onto the buffer or the safety gear of the elevator car grips. To overcome this problem, a device that prevents uncontrolled motion of the hoisting rope set is needed. 'Rope set' refers to one or more parallel ropes in the hoisting roping. FIG. 3 presents a slack rope prevention means 327, the function of which is to ensure that in situations where slackening of the hoisting ropes occurs, such as e.g. when the elevator car is driven onto the buffer 329, the rope elongation accumulated in the rope set of the hoisting ropes 303 can not be completely discharged, so that the hoisting rope remains in its proper position and the hoisting ropes can not be tangled with shaft structures. The slack rope prevention means 327 presented in FIG. 3 is preferably a brake as presented in FIG. 4. The operation of the slack rope prevention means in FIG. 3 fitted in the compensating system is described in more detail in connection with FIG. 4.

Figure 4:
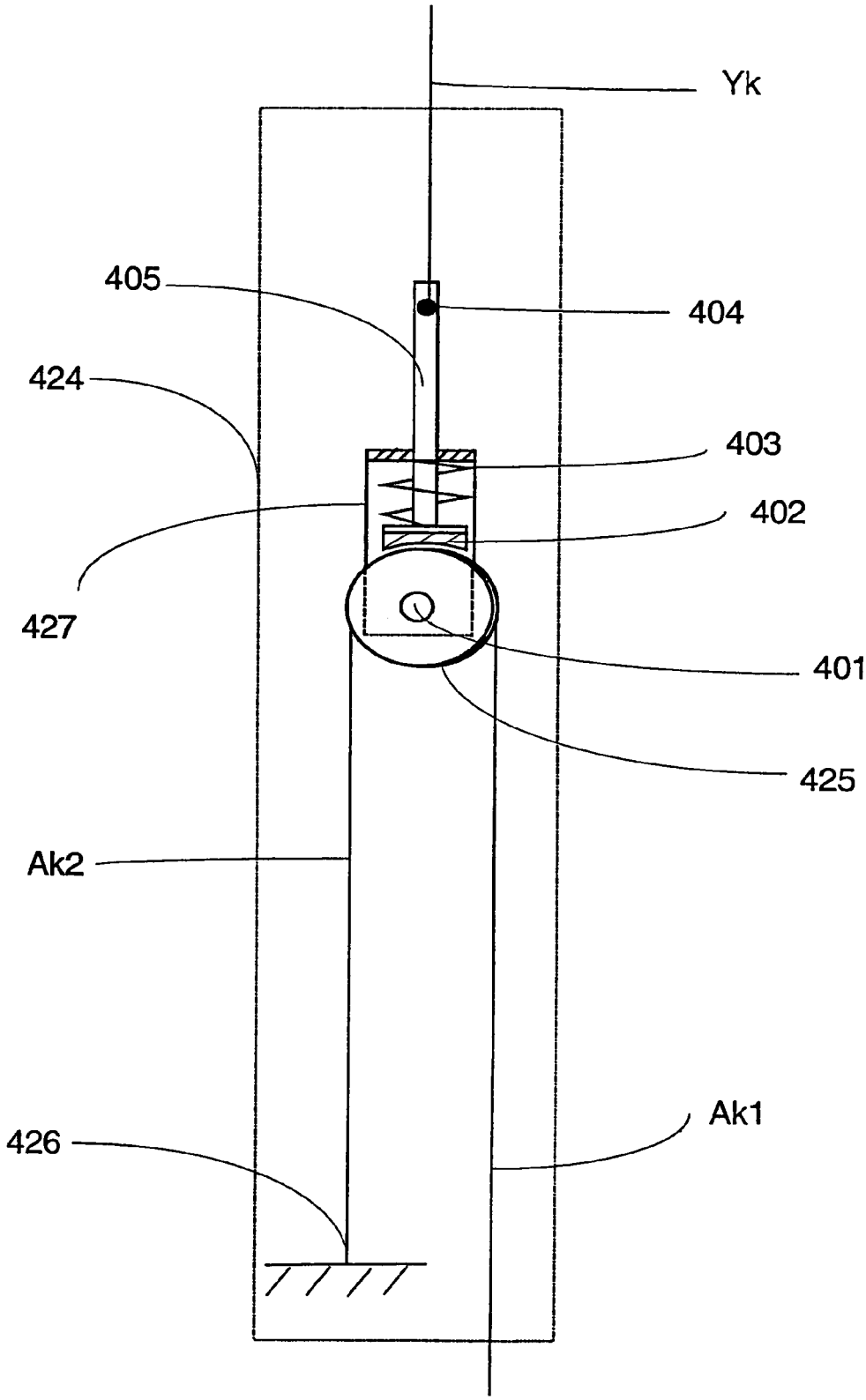
FIG. 4 presents a closer view of the compensating device of the elevator presented in FIG. 3.

FIG. 4 presents a more detailed view of the compensating device 324 of FIG. 3, partially sectioned in the region of the diverting pulley 325 and the brake used in it as a slack rope prevention means 327. The brake presented in FIG. 4, used as a slack rope prevention means, ensures that, e.g. in a situation where the elevator is driven onto the buffer, the rope elongation accumulated in the rope set of the hoisting ropes can not be completely discharged into the hoisting ropes, and thus the hoisting ropes remain in their proper position and cannot be tangled e.g. with shaft structures. The brake presented in FIGS. 3 and 4 as a slack rope prevention means works in such manner that, when the elevator car 301 is driven onto the buffer 329 e.g. in connection with maintenance operation, the stress acting on the hoisting rope portion above the elevator car is reduced, and consequently the rope force $T_1$ is reduced and the rope elongation is discharged into the hoisting ropes, with the result that the diverting pulley 325,425 of the compensating device 324,424 immediately starts moving downwards in the cases of FIGS. 3 and 4. When the rope force $T_1$ acting on the hoisting rope portion $Y_k$ above the elevator car is reduced to a level lower than the spring force of the spring 403, the spring 403 will press the brake pad 402 against the diverting pulley 425, and thus the brake 427 exerts a force opposing the discharge of rope tension and a residual tension remains in the rope set of the hoisting ropes. Due to the residual tension, the rope set remains tight and the hoisting ropes can not be tangled with shaft structures. If the elevator car is driven further downwards against the buffer 329, then the hoisting machine 304 will go on pulling more rope from the hoisting rope portion below the elevator car 301 until the rope force $T_1$ on the other side of the traction sheave 305 is reduced to a level at which the friction between the traction sheave and the hoisting ropes is no longer sufficient and the traction sheave consequently starts slipping. If the compensating device 424 used comprises several compensating sheaves 425, then it is possible to use either one or several slack rope prevention means, such as e.g. brakes 427, acting on one and/or more compensating sheaves. The brake 427 used as a slack rope prevention means may have at least one spring or corresponding system 403 acting on a/the compensating sheave via a braking element 402, which preferably is a brake pad. The compensating sheave 425 is suspended from the hoisting rope portion $Y_k$ above the elevator car at point 401 via the brake 427 or corresponding system used as a slack rope prevention means. In FIG. 4, the hoisting rope portion above the elevator car is attached to the brake 427 at point 404. One end of the hoisting rope portion $A_k$ below the elevator car is fitted in the compensating device 424 and secured to a fixing point 426. In the elevator of the invention, it is also possible to use in the compensating device more than one slack rope prevention means, such as both a slack rope prevention means as presented in FIG. 4, such as a brake, and a slack rope prevention means as presented in FIG. 2, such as a buffer.

A preferred embodiment of the elevator of the invention is an elevator without machine room and with machine above, in which the drive machine has a coated traction sheave and which elevator has thin and hard hoisting ropes of a substantially round cross-section. In the elevator, the contact angle of the hoisting ropes on the traction sheave is greater than 180° and preferably implemented using DW roping in the hoisting machine. The hoisting machine has a traction sheave and a diverting pulley, in which hoisting machine the traction sheave and the diverting pulley are ready fitted in a correct angle relative to each other. The hoisting machine is secured to the elevator guide rails. The elevator is implemented without counterweight with a suspension ratio of 8:1 in such a way that both the suspension ratio of the roping above the elevator car and the suspension ratio of the roping below the elevator car is 8:1, and that the ropes of the elevator run in a space between one wall of the elevator car and the wall of the elevator shaft. The elevator has a compensating device, which maintains a constant ratio between forces $T_1/T_2$ as 2:1. With the compensating device used, the required compensation distance equals half the magnitude of the rope elongation. The compensating device of the elevator comprises at least one slack rope prevention means for preventing uncontrolled slackening of the hoisting ropes and/or uncontrolled motion of the compensating device. In addition, incipient rope slackening is detected by means of an arrangement provided in conjunction with the compensating device and the compensating device is prevented from delivering hoisting rope from the compensating device in the direction of the rope portions below the elevator car.

Another preferred embodiment of the elevator of the invention is an elevator without counterweight in which the suspension ratio above and below the elevator car is 10:1. This embodiment uses conventional elevator ropes, which preferably are ropes of a diameter of 8 mm, and a traction sheave made of cast iron at least in the area of the rope grooves. The traction sheave has undercut rope grooves and the contact angle on the traction sheave has been fitted by means of a diverting pulley to be 180° or greater. When conventional 8-mm ropes are used, the traction sheave preferably has a diameter of 340 mm. The diverting pulleys used are large rope sheaves which, when conventional 8-mm hoisting ropes are used, have a diameter of 320, 330 340 mm or even more.

It is obvious to the person skilled in the art that different embodiments of the invention are not limited to the examples described above, but that they may be varied within the scope of the claims presented below.

For example, the number of times the hoisting ropes are passed between the upper part of the elevator shaft and the elevator car and between the diverting pulleys in the lower part of the elevator shaft and the elevator car is not a very decisive question as regards the basic advantages of the invention, although it is possible to achieve some additional advantages by using multiple rope portions. Embodiments are generally so implemented that the ropes are passed to the elevator car as many times from above as from below, so that the suspension ratios in the suspension above and below the elevator car are the same. In accordance with the examples described above, the skilled person can vary the embodiment of the invention as the traction sheaves and rope pulleys, instead of being coated metal pulleys, may also be uncoated metal pulleys or uncoated pulleys made of some other material suited to the purpose.

It is further obvious to the person skilled in the art that the traction sheaves and rope pulleys made of metal or some other material appropriate for the purpose which are used as diverting pulleys in the invention and which are coated with a non-metallic material at least in the area of their grooves may be implemented using a coating material consisting of e.g. rubber, polyurethane or some other material suited to the purpose.

Figure 5A:
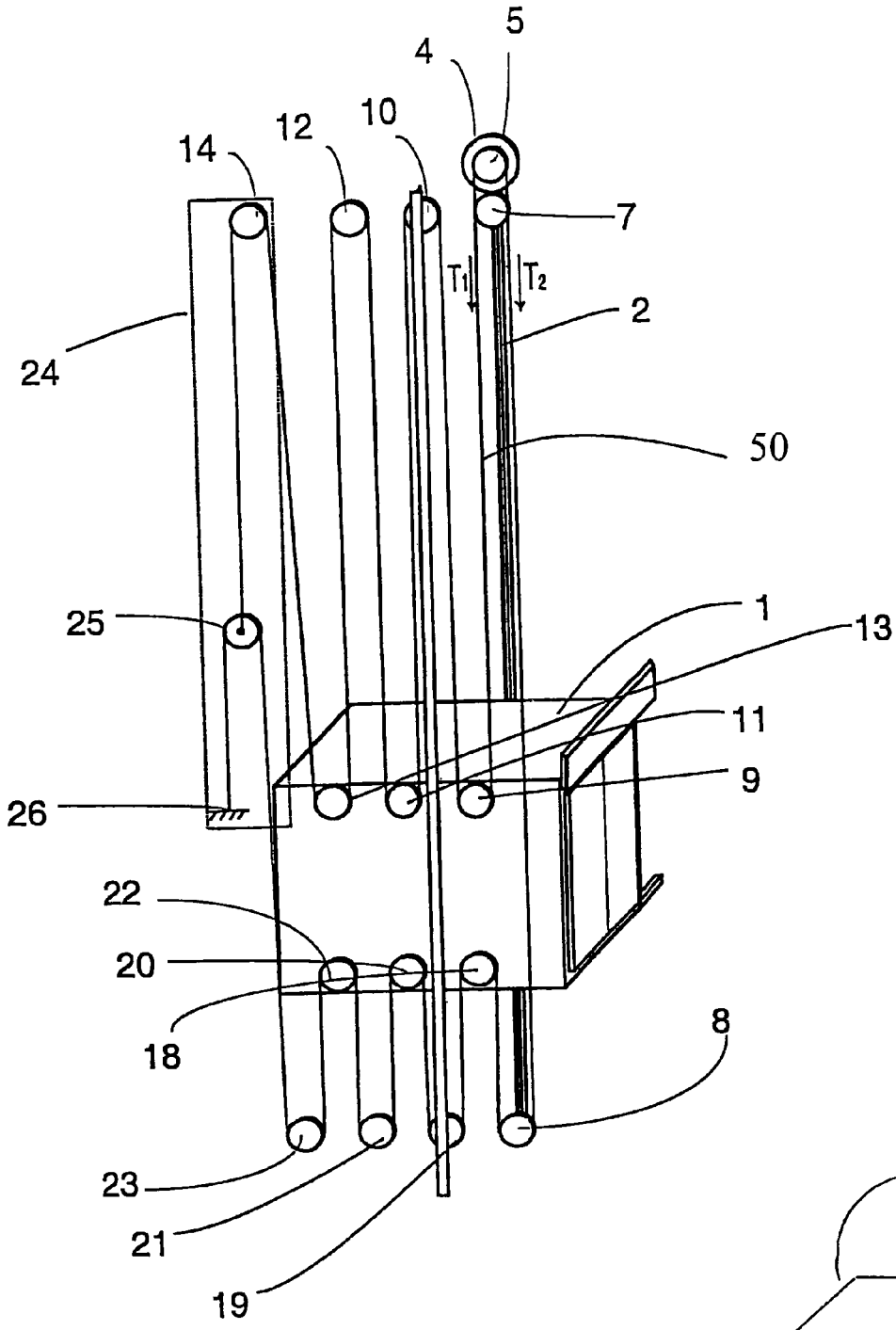
FIG. 5A is a diagram representing a traction sheave elevator, similar to FIG. 1, wherein the set of hoisting ropes includes a flat belt.
Figure 5B:
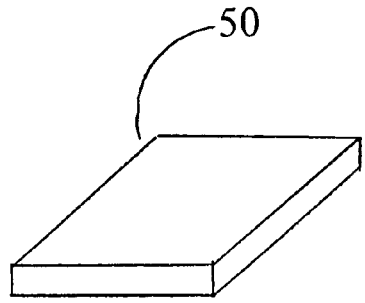
FIG. 5B is a perspective view of a portion of an example flat belt of FIG. 5A.
Figure 6A:
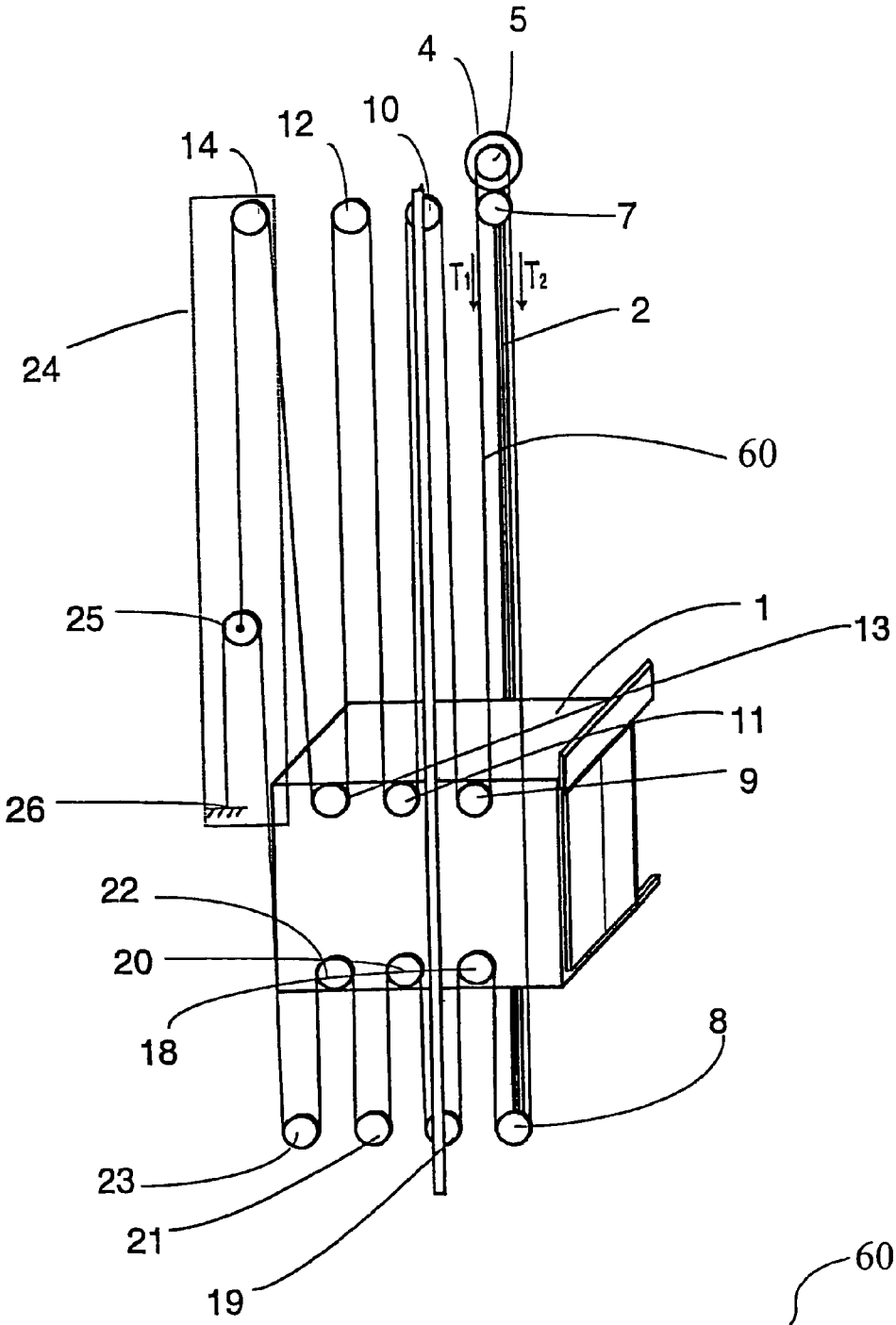
FIG. 6A is a diagram representing a traction sheave elevator, similar to FIG. 1, wherein the set of hoisting ropes includes a cogged belt.
Figure 6B:
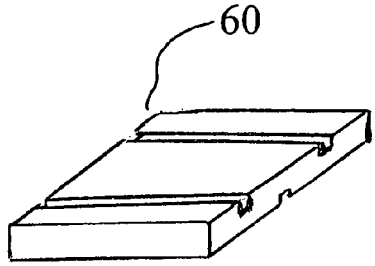
FIG. 6B is a perspective view of a portion of an example cogged belt of FIG. 6A.
Figure 7A:
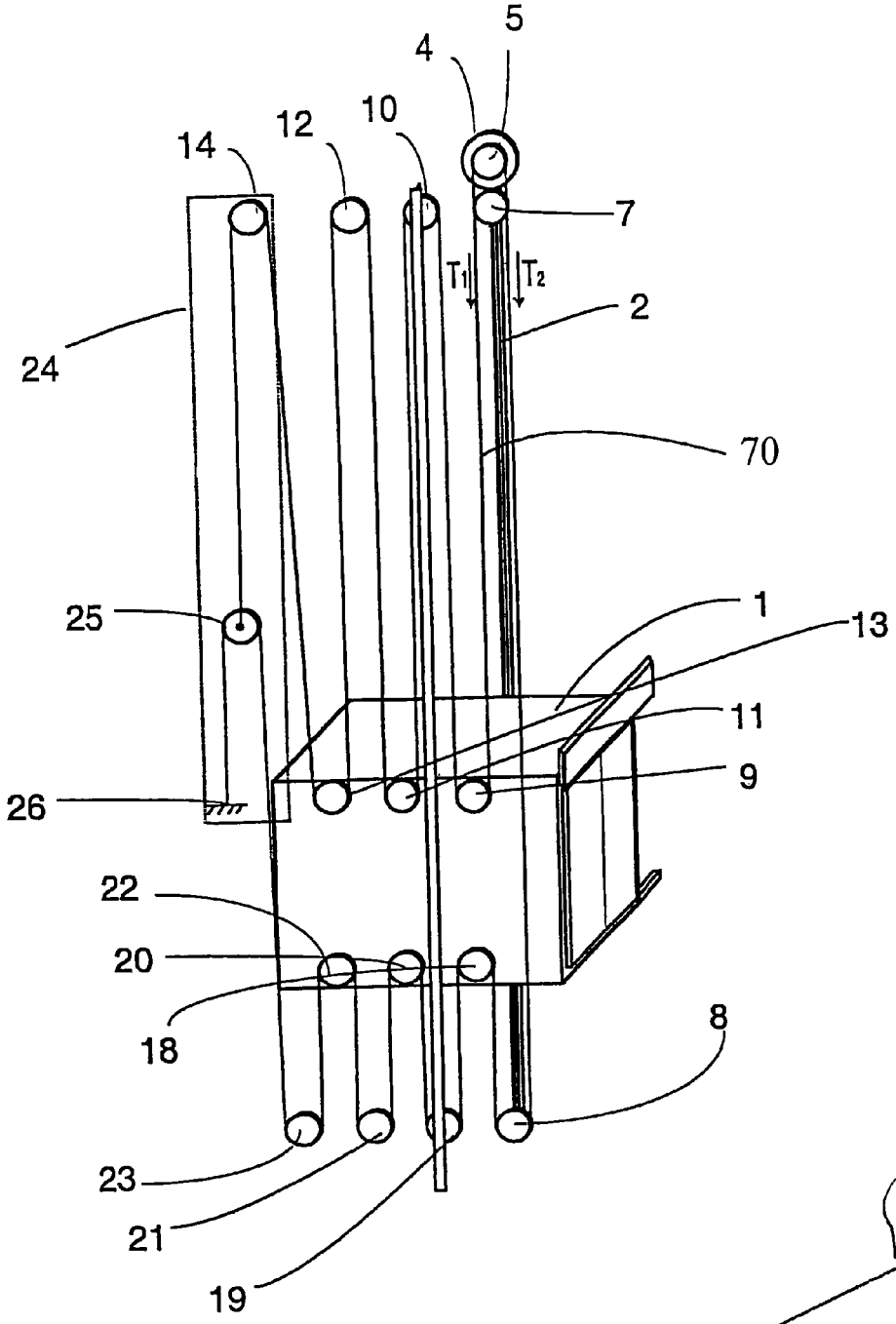
FIG. 7A is a diagram representing a traction sheave elevator, similar to FIG. 1, wherein the set of hoisting ropes includes a trapezoidal belt.
Figure 7B:
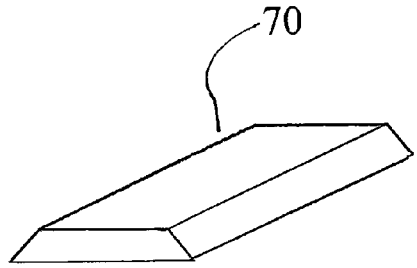
FIG. 7B is a perspective view of a portion of an example trapezoidal belt of FIG. 7A.

It is obvious to the skilled person that the elevator of the invention can be implemented using as hoisting ropes almost any flexible hoisting means, e.g., a flexible rope of one or more strands, a flat belt 50 (as shown, for example, in FIG. 5), a cogged belt 60 (as shown, for example, in FIG. 6), a trapezoidal belt 70 (as shown, for example, in FIG. 7), or some other type of belt suited to the purpose. It is obvious to the skilled person that, instead of using ropes with a filler, the invention can be implemented using ropes without a filler, which are either lubricated or unlubricated. In addition, it is also obvious to the skilled person that the ropes may be twisted in many different ways.

It is also obvious to the person skilled in the art that the elevator of the invention can be implemented using other types of roping between the traction sheave and the diverting pulley/diverting pulleys to increase the contact angle a than the roping arrangements described above as examples. For example, it is possible to arrange the diverting pulley/diverting pulleys, traction sheave, and hoisting ropes in other ways than in the roping examples presented. It is further obvious to the skilled person that the elevator of the invention may also be provided with a counterweight, in which elevator, for example, the counterweight preferably has a weight less than that of the elevator car and is suspended on separate ropes.

Due to the bearing resistance of the rope sheaves used as diverting pulleys and the friction between the ropes and the rope sheaves and also to possible losses occurring in the compensating device, the ratio of the rope tensions may deviate somewhat from the nominal ratio of the compensating device. Even a 5-% deviation is not a significant detriment because the elevator must in any case have a certain in-built robustness.

The invention claimed is:

1. An elevator, comprising:

an elevator car;

a set of hoisting ropes;

a traction sheave; and a compensating device;

wherein the elevator car is at least partially suspended using the set of hoisting ropes, wherein the set of hoisting ropes includes at least one rope or a number of parallel ropes, wherein the traction sheave moves the elevator car using the set of hoisting ropes, wherein the set of hoisting ropes includes first, second, third, and fourth rope portions, wherein the compensating device acts in substantially opposite directions on the first and second rope portions in order to equalize rope tension, equalize rope elongation, or equalize rope tension and equalize rope elongation, wherein the compensating device includes at least one slack rope prevention means for preventing uncontrolled slackening of the set of hoisting ropes, uncontrolled motion of the compensating device, or uncontrolled slackening of the set of hoisting ropes and uncontrolled motion of the compensating device, wherein the elevator car includes one or more diverting pulleys from which the third rope portions extend upwards from the elevator car, and wherein the elevator car includes one or more diverting pulleys from which the fourth rope portions extend downwards from the elevator car.

2. The elevator of claim 1, wherein the at least one slack rope prevention means is a buffer fitted near a compensating sheave, a suspension of the compensating sheave, or the compensating sheave and the suspension of the compensating sheave.

3. The elevator of claim 1, wherein the compensating device further includes:

at least one diverting pulley.

4. The elevator of claim 1, wherein the compensating device is guided by guide rails or guiding ropes.

5. The elevator of claim 1, further comprising: a counterweight.

6. The elevator of claim 1, wherein the elevator does not comprise a counterweight.

7. The elevator of claim 1, wherein the set of hoisting ropes includes a flexible rope of one or more strands.

8. The elevator of claim 1, wherein the set of hoisting ropes includes a flat belt.

9. The elevator of claim 1, wherein the set of hoisting ropes includes a cogged belt.

10. The elevator of claim 1, wherein the set of hoisting ropes includes a trapezoidal belt.

11. The elevator of claim 2, wherein the buffer includes a part damping impact between the compensating sheave and the buffer, and wherein the part includes a gas spring or a rubber pad.

12. An elevator, comprising:

an elevator car;

a set of hoisting ropes;

a traction sheave; and a compensating device;

wherein the elevator car is at least partially suspended using the set of hoisting ropes, wherein the set of hoisting ropes includes at least one rope or a number of parallel ropes, wherein the traction sheave moves the elevator car using the set of hoisting ropes, wherein the set of hoisting ropes includes first, second, third, and fourth rope portions, wherein the compensating device acts in substantially opposite directions on the first and second rope portions in order to equalize rope tension, equalize rope elongation, or equalize rope tension and equalize rope elongation, wherein the third rope portions extend upwards from the elevator car, wherein the fourth rope portions extend downwards from the elevator car, wherein the compensating device includes at least one slack rope prevention means for preventing uncontrolled slackening of the set of hoisting ropes, uncontrolled motion of the compensating device, or uncontrolled slackening of the set of hoisting ropes and uncontrolled motion of the compensating device, wherein the compensating device further includes at least one diverting pulley, and wherein the at least one slack rope prevention means includes a brake acting on the at least one diverting pulley.

13. The elevator of claim 12, wherein the brake includes:

at least one spring or corresponding system; and at least one braking element;

wherein the at least one spring acts on the at least one braking element to brake the at least one diverting pulley in order to maintain tension in the set of hoisting ropes.

14. The elevator of claim 12, wherein the elevator car includes one or more diverting pulleys from which the third rope portions extend upwards from the elevator car, and wherein the elevator car includes one or more diverting pulleys from which the fourth rope portions extend downwards from the elevator car.

15. The elevator of claim 13, wherein the elevator car includes one or more diverting pulleys from which the third rope portions extend upwards from the elevator car, and wherein the elevator car includes one or more diverting pulleys from which the fourth rope portions extend downwards from the elevator car.

16. An elevator, comprising:

an elevator car;

a set of hoisting ropes;

a traction sheave; and a compensating device;

wherein the elevator car is at least partially suspended using the set of hoisting ropes, wherein the set of hoisting ropes includes at least one rope or a number of parallel ropes, wherein the traction sheave moves the elevator car using the set of hoisting ropes, wherein the set of hoisting ropes includes first, second, third, and fourth rope portions, wherein the compensating device acts in substantially opposite directions on the first and second rope portions in order to equalize rope tension, equalize rope elongation, or equalize rope tension and equalize rope elongation, wherein the third rope portions extend upwards from the elevator car, wherein the fourth rope portions extend downwards from the elevator car, wherein the compensating device includes at least one slack rope prevention means for preventing uncontrolled slackening of the set of hoisting ropes, uncontrolled motion of the compensating device, or uncontrolled slackening of the set of hoisting ropes and uncontrolled motion of the compensating device, wherein the compensating device further includes at least one diverting pulley, and wherein the at least one slack rope prevention means includes:

a brake acting on the at least one diverting pulley; and a buffer fitted near a compensating sheave, a suspension of the compensating sheave, or the compensating sheave and the suspension of the compensating sheave.

17. The elevator of claim 16, wherein the elevator car includes one or more diverting pulleys from which the third rope portions extend upwards from the elevator car, and wherein the elevator car includes one or more diverting pulleys from which the fourth rope portions extend downwards from the elevator car.

18. The elevator of claim 4, wherein the guide rails are metallic guide rails.

19. A method for preventing uncontrolled slackening of hoisting ropes in an elevator, wherein the elevator includes an elevator car, a set of hoisting ropes, a traction sheave, and a compensating device, wherein the elevator car is at least partially suspended using the set of hoisting ropes, wherein the set of hoisting ropes includes at least one rope or a plurality of parallel ropes, wherein the traction sheave moves the elevator car using the set of hoisting ropes, wherein the set of hoisting ropes includes first, second, third, and fourth rope portions, wherein the compensating device acts in substantially opposite directions on the first and second rope portions in order to equalize rope tension, equalize rope elongation, or equalize rope tension and equalize rope elongation, wherein the elevator car includes one or more diverting pulleys from which the third rope portions extend upwards from the elevator car, and wherein the elevator car includes one or more diverting pulleys from which the fourth rope portions extend downwards from the elevator car, the method comprising:

detecting incipient rope slackening using an arrangement provided in conjunction with the compensating device;

wherein the compensating device is prevented from delivering hoisting rope from the compensating device in a direction of fourth rope portions.

20. A method for controlling motion of a compensating device in an elevator, wherein the elevator includes an elevator car, a set of hoisting ropes, a traction sheave, and the compensating device, wherein the elevator car is at least partially suspended using the set of hoisting ropes, wherein the set of hoisting ropes includes at least one rope or a plurality of parallel ropes, wherein the traction sheave moves the elevator car using the set of hoisting ropes, wherein the set of hoisting ropes includes first, second, third, and fourth rope portions, wherein the compensating device acts in substantially opposite directions on the first and second rope portions in order to equalize rope tension, equalize rope elongation, or equalize rope tension and equalize rope elongation, wherein the elevator car includes one or more diverting pulleys from which the third rope portions extend upwards from the elevator car, and wherein the elevator car includes one or more diverting pulleys from which the fourth rope portions extend downwards from the elevator car, the method comprising:

detecting incipient rope slackening using an arrangement provided in conjunction with the compensating device;

wherein the compensating device is prevented from delivering hoisting rope from the compensating device in a direction of fourth rope portions.

* * * * *